United States Patent [19]

Blumenthal et al.

[11] 4,028,898

[45] June 14, 1977

[54] PIT PROP ASSEMBLY

[75] Inventors: Günter Blumenthal, Westerholt; Hans-Ferdinand Bemmerl, Herne, both of Germany

[73] Assignee: Bochumer Eisenhutte Heintzmann & Company, Bochum, Germany

[22] Filed: May 11, 1976

[21] Appl. No.: 685,163

[30] Foreign Application Priority Data

May 17, 1975 Germany ..... 2522117

[52] U.S. Cl. ..... 61/45 D

[51] Int. Cl.[2] ..... E21D 15/44

[58] Field of Search ..... 61/45 D; 299/31–33; 91/170 MP, 1, 189; 248/357

[56] References Cited

UNITED STATES PATENTS

| | | | |
|---|---|---|---|
| 3,106,825 | 10/1963 | Barall et al. | 61/45 D |
| 3,811,288 | 5/1974 | Wehner et al. | 61/63 |
| 3,837,170 | 9/1974 | Martinko et al. | 61/45 D |
| 3,896,626 | 7/1975 | Spies et al. | 61/45 D |
| 3,915,500 | 10/1975 | Schlusener et al. | 61/45 D |
| 3,925,995 | 12/1975 | Harmsma et al. | 248/357 |
| 3,949,562 | 4/1976 | Blumenthal et al. | 61/45 D |
| 3,952,525 | 4/1976 | Walker et al. | 61/45 D |

FOREIGN PATENTS OR APPLICATIONS

| | | | |
|---|---|---|---|
| 1,277,789 | 9/1968 | Germany | 61/45 D |

*Primary Examiner*—Dennis L. Taylor
*Attorney, Agent, or Firm*—Michael J. Striker

[57] ABSTRACT

A pit prop assembly has two pit props with parallel laterally spaced bases each having a front end turned toward a face conveyor and a rear end turned away from the face conveyor. A slide has its front end connected via positioning mechanism to the conveyor and its rear end connected via hydraulic ram to the bases. Each of the bases has at its rear end a side turned toward a confronting side on the slide and forming a side pair with this confronting side. One of these sides is formed with a formation that engages over and under another formation on the other side. One of these formations of each of the pairs of formations extends longitudinally toward the face so that the two formations can slide relative to each other. One of these formations may also be a pin whereas the other is a groove, or one may be a pair of facing convex surfaces flanking a straight edge.

15 Claims, 8 Drawing Figures

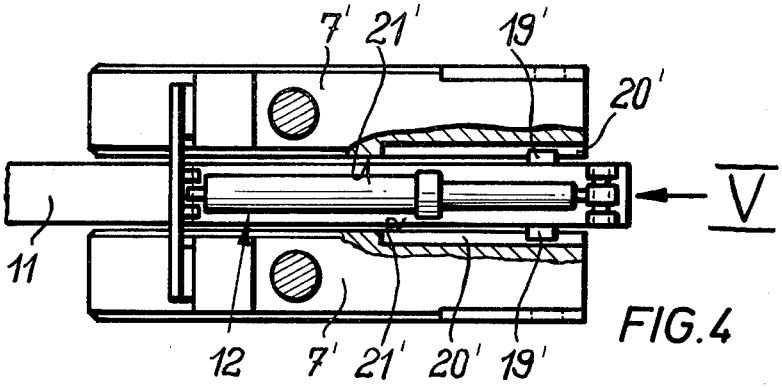
FIG.4
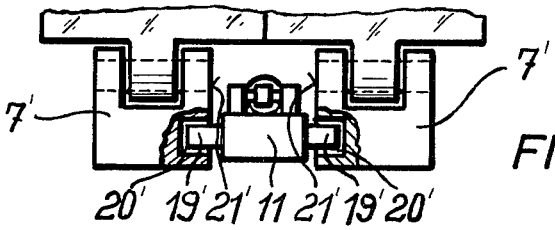
FIG.5
FIG.6
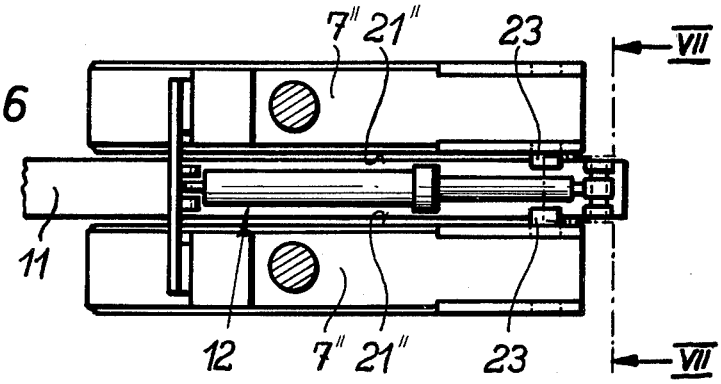
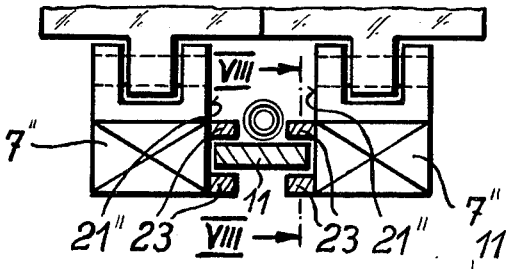
FIG.7
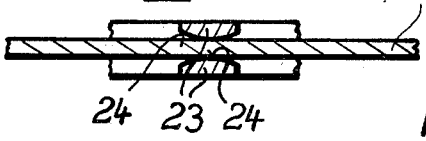
FIG.8

PIT PROP ASSEMBLY

CROSS REFERENCE TO RELATED APPLICATIONS

This application is related to the commonly assigned and copending patent applications Ser. No. 477,084 (now. U.S. Pat. No. 3,949,562), Ser. No. 543,369 (now U.S. Pat. No. 3,959,976), Ser. No. 618,212 (now U.S. Pat. No. 3,961,487), and Ser. No. 685,162, filed June 6, 1974, Jan. 23, 1975, Sept. 30, 1975, and concurrently herewith.

BACKGROUND OF THE INVENTION

The present invention relates to a pit prop assembly. More particularly this invention concerns such an assembly comprising a pair of pit props adapted to be connected to a face conveyor extending along the mine face.

A pit prop assembly frequently comprises a pair of pit props having roof-engaging arms each pivoted on a respective floor-engaging base. A hydraulic ram extends between each base and the respective arm so as to press the arm against the roof and the base against the floor, thereby locking the pit prop in place and holding the roof up to prevent cave-ins. The face conveyor on which is provided the guide along which the face-working device, e.g. a coal plow, moves is connected via a lifting or positioning mechanism to the front end of floor-engaging slide between each pair of bases. This slide is elongated and extends perpendicularly to the face. The rear end of the slide is connected via a hydraulic cylinder to the front ends of the bases. The purpose of this last-mentioned cylinder is to displace the pit props toward or away from the face when their rams are relaxed, or to displace the conveyor toward or away from the face when the pit props are locked between the floor and the roof.

Normally the piston rod of the longitudinal-displacement ram extending between the front ends of the bases and the rear end of the slide is connected to the bases and the cylinder is connected to the slide. This allows the large surface area of the rear face of the piston to be effective in displacement in the pit props toward the face. Similarly the annular space around the piston rod on the other face of the piston is used to stabilize the slide when a face-working device is operating on the face from the front of the face conveyor. Thus, this smaller surface area of the piston alone serves to prevent the slide from pivoting up and down or rocking on its front end as considerable vertical stresses are applied to this front end at the face conveyor. It is therefore necessary to maintain considerable hydraulic pressure at this face of the piston in order to hold the face conveyor and the slide still.

Another disadvantage of this known system is that the considerable lever arm constituted by the slide often tends to press the front or rear end of the slide into the mine floor, especially in cases where a soft spot is under the pit props. Such a settling of the slide can lead to considerable damage of the face conveyor if it is not properly compensated or in the positioning mechanism for this conveyor.

It is possible to overcome these various difficulties by overdimensioning the longitudinal displacement ram and slide. This has the effect of making the device very bulky and quite expensive. In addition the often enormous forces exerted on the slide at the conveyor are still occasionally able to damage the pit props by overstressing the slide and longitudinal-displacement ram.

SUMMARY OF THE INVENTION

It is therefore an object of the present invention to provide an improved pit prop assembly.

Another object is the provision of such an assembly which overcomes the above-given disadvantages.

Yet another object is to improve a pit prop assembly so that relatively great portions can be applied to the slide without misaligning it with its bases or damaging the pit prop assembly.

These objects are attained according to the present invention in a pit prop assembly of the above-described general type wherein each of the bases has at its rear end a side turned toward the slide and the slide has at its rear end opposite lateral sides each turned toward and forming a pair with the confronting side of the respective base. The pair of confronting sides have interengaging formations one of which engages over and under the other. One of the formations of each pair is elongated in the longitudinal direction of the bases and slide toward the face for sliding of the two formations on each other in this longitudinal direction.

Thus, with the system according to the present invention the rear end of the slide is vertically linked to the bases of the pit props. This considerably reduces the moment of force exerted on this slide so that it is not necessary to overdimension it in order to compensate for the forces that will be vertically applied to the slide at the face conveyor. The interengaging formations will not, however, in any way interfere with the relative sliding of the slider and the bases.

According to further features of this invention one of the formations is formed with a pair of oppositely vertically directed convex surfaces, the other formation of each pair is therefore the elongated formation and has a pair of parallel planar side surfaces that are vertically spaced and each engage a respective one of these convex surfaces which, according to the invention, are part cylindrical and have central axes parallel to the face.

According to this invention a pin having an upper and a lower surface constituting the part cylindrical surfaces may constitute the one formation and a groove may constitute the other. This pin may be formed on the base and the groove in the slider, or vice versa.

According to yet another feature of this invention the concave surfaces are turned toward one another and vertically flank an edge of the other side that constitutes the other formation. This edge may be the longitudinal edge of the slider. In all cases the one formation vertically flanks the other formation with limited vertical play.

The face conveyor according to this invention extends parallel to the face and transversely or perpendicularly to the longitudinal direction defined by the bases of the pit props. This conveyor is provided with a guide along which can slide or roll the face-working device. Furthermore, the coal conveyor is secured via a horizontal pivot to the front end of each of the slides and above this pivot is effective a short ram that can tip the conveyor or the slide about this horizontal pivot.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 is a view similar to FIG. 2 illustrating another pit prop assembly according to this invention;

FIG. 5 is a view partly in section taken in the direction of arrow V of FIG. 4;

FIG. 6 is a view similar to FIG. 2 illustrating yet another pit prop assembly according to this invention; and FIGS. 7 and 8 are sections taken along lines VII—VII and VIII—VIII of FIGS. 6 and 7, respectively.

DESCRIPTION OF THE PREFERRED EMBODIMENTS

Figure 1:
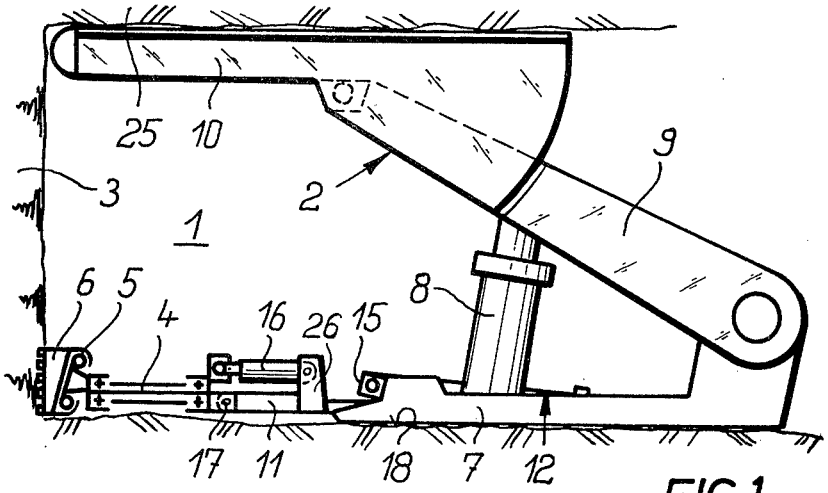
FIG. 1 is a vertical section through a mine showing a pit prop assembly in side view.

As shown in FIG. 1 a mine 1 has a face wall 3 defined beneath roof 25 and floor 18. Extending along the face 3 next to a succession of pit props 2 is a face conveyor 4 defining a transverse direction shown in FIG. 2 by double-headed arrow T. This conveyor 4 is formed by a succession of chutes or troughs and is itself formed with a guide 5 along which is displaceable a coal plow.

Figure 2:
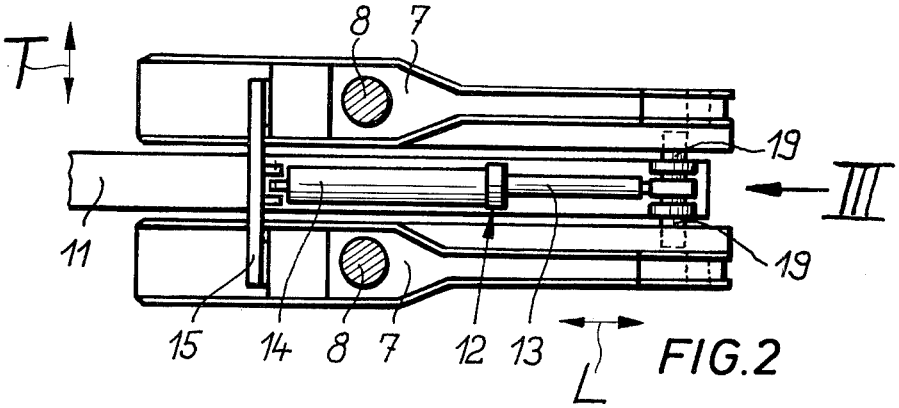
FIG. 2 is horizontal section through the pit prop assembly of FIG. 1.

Each prop 2 comprises, as also shown in FIG. 2, a base 7 extending in a longitudinal direction L perpendicular to the direction T and having a front end at least twice as wide as its rear end. Pivoted on the narrow rear end of each of these bases 7 is an arm 9 carrying a roof shield 10 which may be pressed against the roof 25 by means of a ram 8.

A slide 11 constituted as a heavy bar extending in the direction L is connected at its rear end to the piston rod 13 of a ram 12 connected at its front end 14 to a traverse 15 extending between the front ends of the bases 7. At its front end the slide 11 has a pivot 17 secured to the conveyor 4, with a short hydraulic ram 16 secured to an upright 26 on the slide 11 and a point above the pivot 17.

Figure 3:
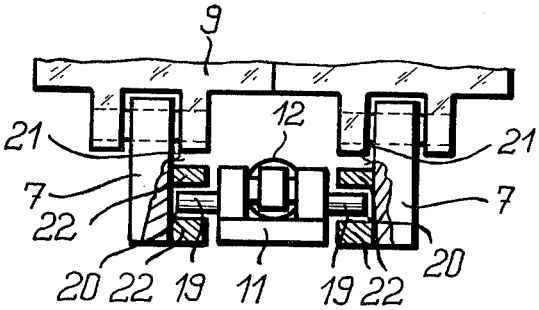
FIG. 3 is a view partly in section taken in the direction of arrow III of the assembly of FIG. 2.

As also shown in FIG. 3 the rear end of the slide 11 is provided with a pair of opposite and perpendicularly extending pins 19 of cylindrical shape extending in the direction T and engaging in a groove 20 defined between a pair of formations or ridges 22 formed on the inside faces 21 of the bases 7 at their rear end. These ridges or flanges 22 extend parallel to one another in the direction L so that the pins 19 may slide in them in this direction L.

Thus, any moment of force, typically exerted on the slide 11 at the pivot 17, will be transmitted directly to pit prop 2 via the pins 19. This will greatly decrease the wear to which the pit prop assembly is subjected.

In an arrangement as shown in FIGS. 4 and 5 wherein the bases 7′ are of regular width, not tapered at their rear ends as shown in FIGS. 1 and 2, grooves 20′ are formed on their confronting faces 21′ and, again, cylindrical pins 19′ extending perpendicularly from the side surfaces of the slider 11 engage in these grooves 20′. Again, considerable relative sliding of the elements 11 and 7′ relative to each other is possible.

The arrangement of FIGS. 6–8 again has uniform-section bases 7″ which each have inner faces 21′ formed at their rear ends with inwardly extending vertically spaced pairs of lugs 23 that engage over and under the edges of the slider bar 11. Thus, the edges of the slider 11 in this arrangement constitute the formations engage by the formations 23 on the bases 7. FIG. 8 also shows how these formations 23 have concave part-cylindrical surfaces 24 turned toward each other for line contact of themselves with the slider 7.

It can be seen that all arrangements described above have one formation which is elongated in the direction L and another formation which is relatively short in this direction. In addition, one of the formations engages the other formation in line contact for pivoting relative thereto about a horizontal axis parallel to the direction T.

It will be understood that each of the elements described above, or two or more together, may also find a useful application in other types of structure differing from the types described above.

While the invention has been illustrated and described as embodied in a pit prop assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. In a mining assembly comprising: a face conveyor extending along a mine floor; an elongated slide defining a longitudinal direction transverse to the direction of extension of said conveyor and having a front end pivoted on said face conveyor and a rear end turned away from said face conveyor; a pair of pit props having floor-engaging elongated bases flanking said slide and each having a front end turned said conveyor and a rear end turned away from said conveyor; displacement means including a longitudinally extending fluid-operated ram pivoted on said front ends of said bases and on said rear end of said slide for longitudinally relatively displacing said slide and said bases, whereby when said face conveyor is fixed said ram can longitudinally displace said props and when said props are fixed said ram can longitudinally displace said conveyor; and positioning means on said front end of said slide and connected to said face conveyor for vertically displacing said conveyor relative to said front end of said slide, whereby upward displacement of said conveyor by said positioning means urges said front end of said slide downwardly and said rear end of said slide upwardly and downward displacement of said conveyor by said positioning means urges said front end of said slide upwardly and said rear end of said slide downwardly, the improvement wherein each of said bases has at its rear end a side turned toward said slide and said slide has at its rear end opposite lateral sides each turned toward and forming a pair with the confronting side of the respextive base, each pair of confronting sides having interengaging formations one of which engages over and under the formation of the other side of the respective pair, one of said formations being elongated in said longitudinal direction.

2. The improvement defined in claim 1 wherein one of said formations of each pair of confronting sides is at least one projection having upwardly and downwardly convex surfaces.

3. The improvement defined in claim 2 wherein said surfaces are turned vertically toward each other and the other formation of each pair is received therebetween.

4. The improvement defined in claim 3 wherein said projections are formed on said bases and said other formation is constituted by the edge of said slide at its rear end.

5. The improvement defined in claim 2 wherein each projection is a pin extending generally parallel to the face and each of said other formations is a groove extending horizontally and transversely to said face.

6. The improvement defined in claim 2 wherein said pins are provided on said bases.

7. The improvement defined in claim 2 wherein said pins are provided on said slide.

8. The improvement defined in claim 2 wherein said surfaces are part cylindrical and centered on respective axes parallel to said face, said other formations having planar horizontal surfaces extending toward said face and engaging the part-cylindrical surfaces in line contact.

9. The improvement defined in claim 8 wherein each prop has pivoted on its base a roof-engaging arm and extending between its base and its arm a hydraulic ram.

10. The improvement defined in claim 8 wherein said conveyor carries a mining device displaceable on said conveyor along a mine face.

11. The improvemment defined in claim 1 wherein said slide has an upright extending upwardly from its front end and said positioning means includes a fluid-operated cylinder pivoted on said face conveyor and on said upright, whereby longitudinal extension and contraction of said cylinder pivots said conveyor on said front end of said slide.

12. The improvement defined in claim 1 wherein said fluid-operated cylinder, said fluid-operated ram, said bases, said slide, and said face conveyor are all pivoted together and relatively pivotal about generally parallel axes generally perpendicular to said longitudinal direction.

13. The improvement defined in claim 1 wherein said slide is substantially longer in said direction than said bases.

14. The improvement defined in claim 1 wherein said assembly includes a plurality of pivots defining generally parallel horizontal axes generally perpendicular to said directions, one of said pivots interconnecting said positioning means and said face conveyor, another of said pivots interconnecting said face conveyor and said front end of said slide, another of said pivots interconnecting said rear end of said slide and said ram, and another of said pivots interconnecting said ram and said front ends of said bases.

15. The improvement defined in claim 1 wherein said front end of said slide can move vertically freely relative to said front ends of said bases.

* * * * *